US011106154B2

(12) United States Patent
Kato et al.

(10) Patent No.: US 11,106,154 B2
(45) Date of Patent: Aug. 31, 2021

(54) DEVELOPING DEVICES INCLUDING DEVELOPING ROLLERS AND DISCHARGE CHANNELS

(71) Applicant: HEWLETT-PACKARD DEVELOPMENT COMPANY, L.P., Spring, TX (US)

(72) Inventors: Yuya Kato, Kanagawa (JP); Shinichiro Suzukawa, Kanagawa (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/049,892

(22) PCT Filed: Jul. 17, 2019

(86) PCT No.: PCT/US2019/042133
§ 371 (c)(1),
(2) Date: Oct. 22, 2020

(87) PCT Pub. No.: WO2020/018625
PCT Pub. Date: Jan. 23, 2020

(65) Prior Publication Data

US 2021/0072663 A1 Mar. 11, 2021

(30) Foreign Application Priority Data

Jul. 19, 2018 (JP) ..... JP2018-135895

(51) Int. Cl.
*G03G 15/08* (2006.01)

(52) U.S. Cl.
CPC ..... *G03G 15/0808* (2013.01); *G03G 15/0812* (2013.01); *G03G 15/0898* (2013.01); *G03G 2215/0827* (2013.01)

(58) Field of Classification Search
CPC ..... G03G 15/0844; G03G 15/095
See application file for complete search history.

(56) References Cited

U.S. PATENT DOCUMENTS 4,376,578 A * 3/1983 Tanaka ..... G03G 21/105 15/256.5
4,894,688 A * 1/1990 Taniguchi ..... G03G 15/0822 399/359

(Continued)

FOREIGN PATENT DOCUMENTS

JP 2000137376 5/2000
JP 2004206150 7/2004

(Continued)

*Primary Examiner* — Walter L Lindsay, Jr.
*Assistant Examiner* — Milton Gonzalez
(74) *Attorney, Agent, or Firm* — Trop Pruner & Hu, P.C.

(57) ABSTRACT

An imaging system includes a developing roller connected to a supply channel to supply a developing agent and to transfer toner in the developing agent to a photosensitive drum at a supply position, a regulation member located adjacent to the developing roller at an upstream side of the supply position to restrict a thickness of the developing agent; and a casing that forms a release chamber in the periphery of the developing roller between an upstream side of the regulation member and a downstream side of the supply position. The release chamber includes an outlet to discharge scattered toner to an inlet of the supply channel.

19 Claims, 14 Drawing Sheets

(56) References Cited

U.S. PATENT DOCUMENTS

| | | | | |
|---|---|---|---|---|
| 5,499,090 | A * | 3/1996 | Ito | G03G 21/105 399/120 |
| 6,002,898 | A | 12/1999 | Yokomori | |
| 7,885,583 | B2 * | 2/2011 | Shigehiro | G03G 15/0896 399/272 |
| 8,620,177 | B2 * | 12/2013 | Carot | G03G 15/0817 399/103 |
| 2007/0025773 | A1 | 2/2007 | Tateyama | |
| 2009/0041508 | A1 | 2/2009 | Oshikawa | |
| 2015/0338777 | A1 | 11/2015 | Matsumoto | |

FOREIGN PATENT DOCUMENTS

| | | |
|---|---|---|
| JP | 2006039595 | 2/2006 |
| JP | 2007058002 | 3/2007 |
| JP | 2007316665 | 12/2007 |

* cited by examiner

DEVELOPING DEVICES INCLUDING DEVELOPING ROLLERS AND DISCHARGE CHANNELS

BACKGROUND

An image forming apparatus may include a photosensitive body, a charging device, an exposing device forming an electrostatic latent image on the photosensitive body, a developing device developing the electrostatic latent image by applying toner thereto, and a transfer device transferring a toner image on the photosensitive body to a transfer material.

DETAILED DESCRIPTION

Figure 1:
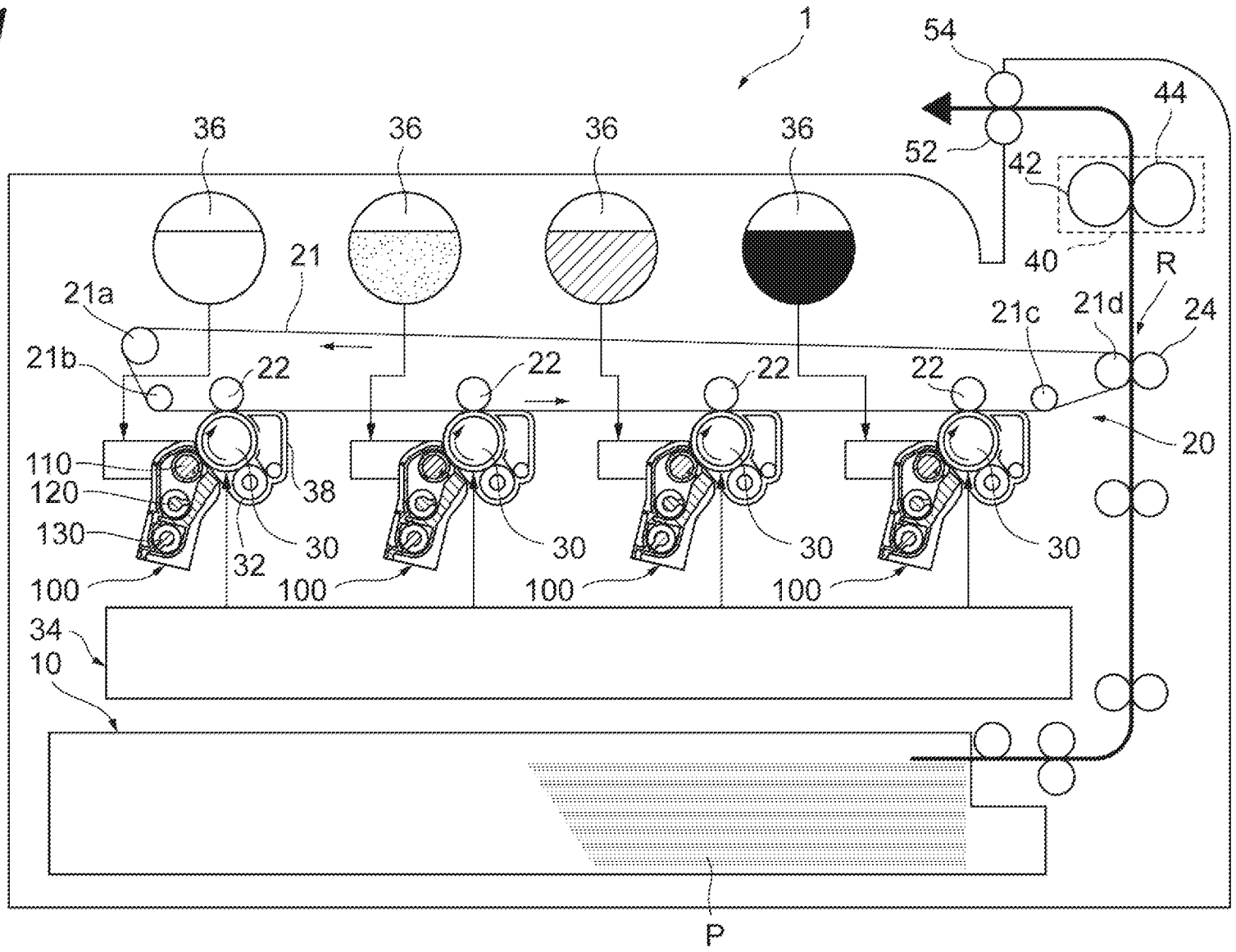
FIG. 1 is a schematic diagram illustrating a configuration of an example image forming apparatus.

In the following description, with reference to the drawings, the same reference numbers are assigned to the same components or to similar components having the same function, and overlapping description is omitted. Further, the dimensional ratios of the drawings are not limited to the ratios illustrated in the drawings.

As illustrated in FIG. 1, an example image forming apparatus 1 may include a recording medium conveying unit 10, a transfer unit 20, a photosensitive drum 30, four developing devices 100, and a fixing unit 40. The imaging apparatus 1 may be a printer, a component of an imaging system, or an imagining system. For example, the imaging apparatus may comprise a developing device used in an imaging system or the like.

The recording medium conveying unit 10 accommodates a paper (or paper sheet) P or other type of recording medium on which an image is formed. Further, the recording medium conveying unit 10 conveys the paper P onto a recording medium conveying route. The paper P is stacked in a cassette. The recording medium conveying unit 10 allows the paper P to reach a secondary transfer region R at a timing in which a toner image transferred to the paper P reaches the secondary transfer region R.

The transfer unit 20 conveys the toner image formed by the photosensitive drum 30 to the secondary transfer region R in which the toner image is secondarily transferred to the paper P. The transfer unit 20 includes, for example, a transfer belt 21, suspension rollers 21*a*, 21*b*, 21*c*, and 21*d* suspending the transfer belt 21, a primary transfer roller 22 sandwiching the transfer belt 21 along with the photosensitive drum 30, and a secondary transfer roller 24 sandwiching the transfer belt 21 along with the suspension roller 21*d*.

The transfer belt 21 is an endless belt which is moved in a circulating manner by the suspension rollers 21*a*, 21*b*, 21*c*, and 21*d*. The primary transfer roller 22 is provided to press the photosensitive drum 30 from the inner peripheral side of the transfer belt 21. The secondary transfer roller 24 is provided to press the suspension roller 21*d* from the outer peripheral side of the transfer belt 21. Further, the transfer unit 20 may include a belt cleaning device or the like for removing toner adhering to the transfer belt 21.

The photosensitive drum 30 is an electrostatic latent image carrier in which an image is formed on a peripheral surface. The photosensitive drum 30 may be, for example, an organic photo conductor (OPC). The image forming apparatus 1 may include an apparatus capable of forming a color image. In some examples, four photosensitive drums 30 are provided in the movement direction of the transfer belt 21 to correspond to, for example, yellow, magenta, cyan, and black colors. As illustrated in FIG. 1, a charging roller 32, an exposure unit 34, a developing device 100, and a cleaning unit 38 may be provided on the periphery of each photosensitive drum 30.

The charging roller 32 uniformly charges the surface of the photosensitive drum 30 to a predetermined potential. The exposure unit 34 exposes the surface of the photosensitive drum 30 charged by the charging roller 32 in response to an image formed on the paper P. Accordingly, a potential of a portion exposed by the exposure unit 34 in the surface of the photosensitive drum 30 changes so that an electrostatic latent image is formed. Toner is supplied from a toner tank 36 corresponding to each developing device 100 to each of four developing devices 100. The developing device 100 generates a toner image by developing the electrostatic latent image formed on the photosensitive drum 30 using the toner. Four toner tanks 36 are respectively charged with, for example, a replenishment developing agent in which yellow, magenta, cyan, and black toners are mixed with carrier.

The cleaning unit 38 collects the toner remaining on the photosensitive drum 30 after the toner image on the photosensitive drum 30 is primarily transferred to the transfer belt 21. The cleaning unit 38 may remove the residual toner on the photosensitive drum 30 by bringing, for example, a cleaning blade into contact with the peripheral surface of the photosensitive drum 30. Furthermore, a charge eliminating lamp which resets the potential of the photosensitive drum 30 may be disposed between the cleaning unit 38 and the charging roller 32 in the rotation direction of the photosensitive drum 30 on the periphery of the photosensitive drum 30.

The fixing unit 40 fixes the toner image (i.e., the toner image secondarily transferred from the transfer belt 21 to the paper P) to the paper P. The fixing unit 40 includes, for example, a heating roller 42 and a pressing roller 44. The heating roller 42 includes a cylindrical member that is rotatable about a rotation shaft. For example, a heat source such as a halogen lamp is provided inside the heating roller 42. The pressing roller 44 includes a cylindrical member that is rotatable about a rotation shaft. The pressing roller 44 is provided to press the heating roller 42. For example, a heat resistant elastic layer such as silicon rubber is provided on the outer peripheral surfaces of the heating roller 42 and the pressing roller 44. The toner image is melted and fixed to the paper P in such a manner that the paper P passes through a fixing nip portion corresponding to a contact region between the heating roller 42 and the pressing roller 44.

Further, the image forming apparatus 1 may be provided with discharge rollers 52 and 54 that discharge the paper P onto which the toner image is fixed by the fixing unit 40 to the outside of the apparatus.

Next, an example operation of the image forming apparatus 1 will be described. When an image signal of a recording target image is input to the image forming apparatus 1, a control unit of the image forming apparatus 1 uniformly charges the surface of the photosensitive drum 30 to a predetermined potential by the charging roller 32. Then, the control unit of the image forming apparatus 1 forms an electrostatic latent image by irradiating a laser beam to the surface of the photosensitive drum 30 by the exposure unit 34 based on a received image signal.

The developing device 100 mixes toner and carrier at a predetermined mixing ratio. The developing device 100 adjusts the developing agent to apply an optimal charge amount by uniformly dispersing toner. The adjusted developing agent is carried (held) by a developing roller 110. Then, when the developing agent is conveyed to a region (a supply position) facing the photosensitive drum 30, the toner in the developing agent carried by the developing roller 110 moves to the electrostatic latent image formed on the peripheral surface of the photosensitive drum 30 in accordance with the rotation of the developing roller 110 so that the electrostatic latent image is developed. The toner image which is formed in this way is primarily transferred from the photosensitive drum 30 to the transfer belt 21 in a region in which the photosensitive drum 30 faces the transfer belt 21. The toner images formed on four photosensitive drums 30 are sequentially superimposed (or layered) on the transfer belt 21 so that a single composite toner image is formed. Then, the composite toner image may be secondarily transferred to the paper P conveyed from the recording medium conveying unit 10 in the secondary transfer region R in which the suspension roller 21*d* faces the secondary transfer roller 24.

The paper P to which the composite toner image is secondarily transferred is conveyed to the fixing unit 40. When the paper P passes between the heating roller 42 and the pressing roller 44 while being heated and pressed, the composite toner image is melted and fixed to the paper P. Subsequently, the paper P is discharged to the outside of the image forming apparatus 1 by the discharge roller 52 and 54. When a belt cleaning device is provided, the toner remaining on the transfer belt 21 is removed by the belt cleaning device after the composite toner image is secondarily transferred to the paper P.

With reference to the schematic diagram shown in FIG. 2, a configuration of the example developing device 100 will be described. The developing device 100 uses, for example, a two-component developing agent including toner and carrier as the developing agent. Further, the developing device 100 discharges an old developing agent having been used for a long time from a developing agent discharge port and replenishes a new developing agent into a developing agent storage chamber.

Figure 2:
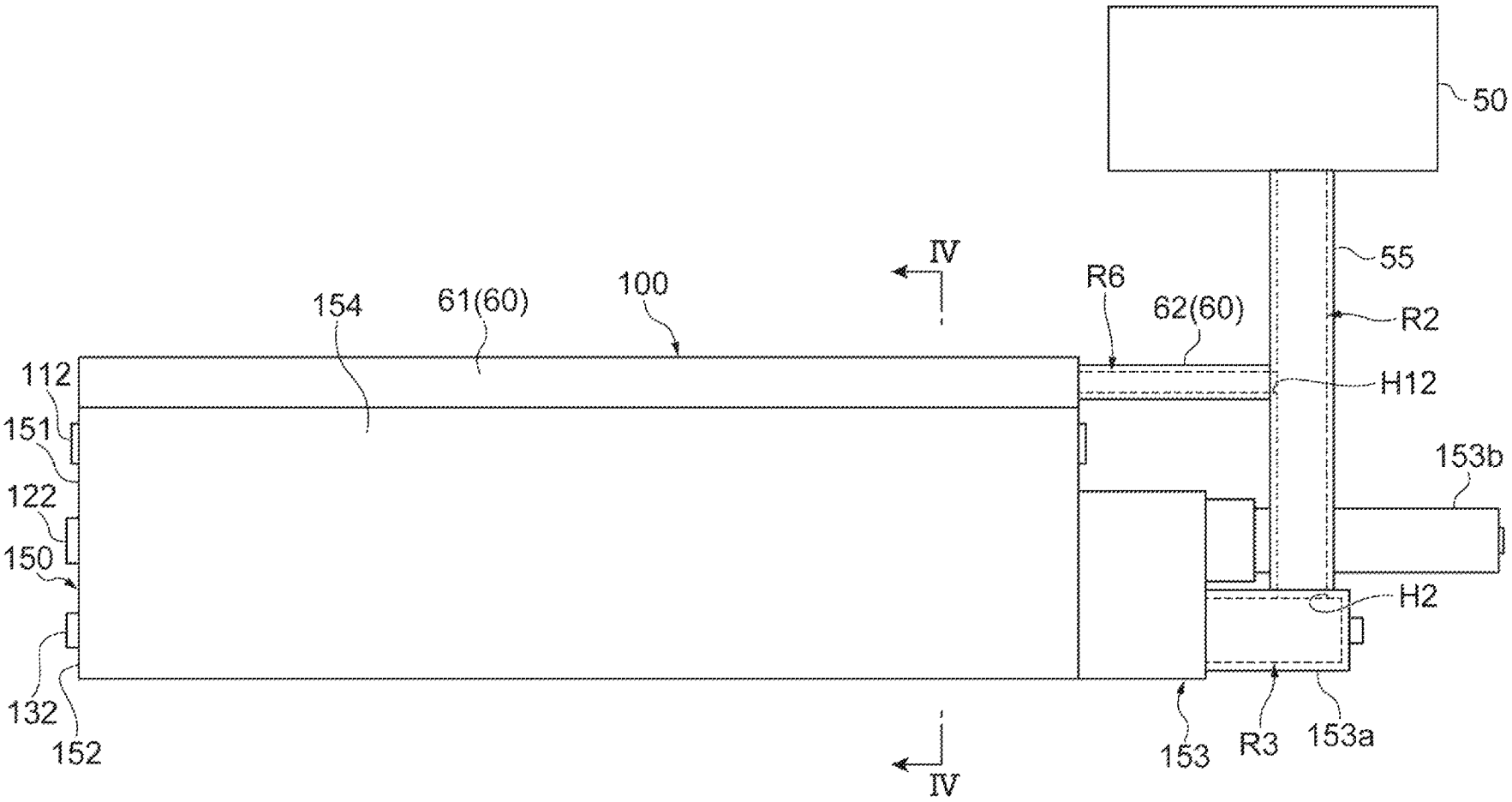
FIG. 2 is a schematic diagram illustrating a configuration of an example developing device of the image forming apparatus of FIG. 1.
Figure 3:
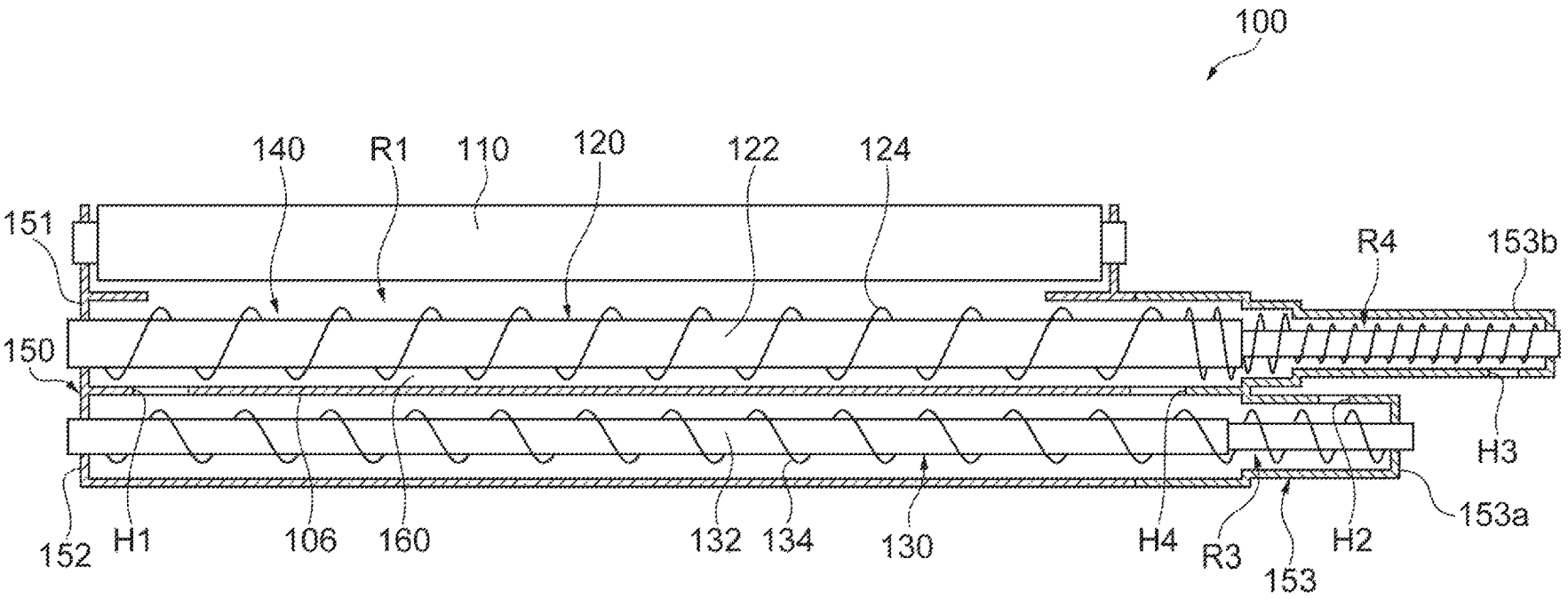
FIG. 3 is a schematic cross-sectional view illustrating an internal configuration of the developing device of FIG. 2.

As illustrated in FIGS. 2 and 3, the example developing device 100 may include a developing roller 110, a first conveying member 120, and a second conveying member 130. The developing roller 110, the first conveying member 120, and the second conveying member 130 are provided inside a developing agent storage chamber 160 formed by a housing 150 of the developing device 100.

The developing roller 110 includes a developing agent carrier which supplies toner to the electrostatic latent image formed on the peripheral surface of the photosensitive drum 30.

The first conveying member 120 and the second conveying member 130 mix the magnetic carrier and the nonmagnetic toner constituting the developing agent in the developing agent storage chamber 160 to frictionally charge the carrier and the toner.

The housing 150 includes, for example, a first housing 151, a second housing 152, and a third housing 153. The first housing 151 accommodates the developing roller 110 and the first conveying member 120. The second housing 152 accommodates the second conveying member 130. The third housing 153 is connected to the end portions of the first housing 151 and the second housing 152. The third housing 153 accommodates the end portions of the first conveying member 120 and the second conveying member 130.

The developing roller 110 includes, for example, a rotation shaft 112. Both end portions of the rotation shaft 112 are supported by, for example, the first housing 151 to be rotatable.

The first conveying member 120 supplies the mixed developing agent to the developing roller 110. The first conveying member 120 includes, for example, a first support shaft 122 and a first conveying blade 124. The first support shaft 122 is rotatably supported by the first housing 151 and the third housing 153. The first conveying blade 124 is provided on the outer peripheral surface of the first support shaft 122. The first conveying blade 124 includes a spiral slope surface which is disposed in the longitudinal direction of the first support shaft 122.

The second conveying member 130 is used to charge the developing agent by mixing the developing agent. The second conveying member 130 conveys the charged developing agent to the first conveying member 120. Similarly to the first conveying member 120, the second conveying member 130 includes, for example, a second support shaft 132 and a second conveying blade 134. The second support shaft 132 is rotatably supported by the second housing 152 and the third housing 153. The second conveying blade 134 is provided on the outer peripheral surface of the second support shaft 132. The second conveying blade 134 includes a spiral slope surface which is disposed in the longitudinal direction of the second support shaft 132.

The first conveying member 120 and the second conveying member 130 are disposed so that, for example, the first support shaft 122 and the second support shaft 132 are substantially parallel to each other. The first housing 151 and the second housing 152 are provided to be adjacent to each other in a substantially vertical direction. In some examples, a lower portion of the first housing 151 and an upper portion of the second housing 152 are formed by one member (hereinafter, referred to as a "partition plate 106"). The partition plate 106 may operate as a part of the first housing 151 and a part of the second housing 152. The partition plate 106 separates the first conveying member 120 from the second conveying member 130. The partition plate 106 is provided with an first connection port H1. The first connection port H1 is provided in the vicinity of the end portion opposite to the end portion supported by the third housing 153 in the first conveying member 120. The first connection port H1 delivers the developing agent from the inside of the second housing 152 into the first housing 151.

The developing agent which is conveyed while being mixed by the second conveying member 130 inside the second housing 152 is sent into the first housing 151 through the first connection port H1. The first conveying blade 124 of the first conveying member 120 conveys the developing agent from the first connection port H1 toward the third housing 153 while mixing the developing agent. In a state in which the developing agent is conveyed by the first conveying member 120, a part of the developing agent moves to the peripheral surface of the developing roller 110. In this way, a space inside the first housing 151 and the second housing 152 defines a conveying channel 140 to convey the developing agent along a conveying route R1 which supplies the developing agent (toner) to the developing roller 110. The remaining developing agent which does not move to the peripheral surface of the developing roller 110 is sent from the inside of the first housing 151 into the third housing 153 and is returned from the inside of the third housing 153 into the second housing 152.

For example, as illustrated in FIGS. 2 and 3, the third housing 153 includes, for example, a loading channel 153*a* and a developing agent discharge channel 153*b*. The loading channel 153*a* accommodates the end portion of the second conveying member 130 and supports the end portion. The loading channel 153*a* is provided with a developing agent replenishment port H2. In some examples, as illustrated in FIG. 2, the image forming apparatus 1 includes a developing agent supply unit 50 which supplies the toner inside the toner tank 36 to the developing device 100. A supply channel 55 is connected to the developing agent supply unit 50. A supply route R2 which supplies the developing agent including the toner is provided inside the supply channel 55. The end portion of the supply channel 55 is connected to the developing agent replenishment port H2 of the loading channel 153*a*. A replenishment developing agent (toner and carrier) is supplied from the supply route R2 into the loading channel 153*a* through the developing agent replenishment port H2.

The replenishment developing agent which is supplied into the loading channel 153*a* passes through the loading channel 153*a* and is sent to the conveying route R1 inside the second housing 152. A space inside the loading channel 153*a* serves as a loading route R3 connecting the supply route R2 inside the supply channel 55 to the conveying route R1 inside the second housing 152. In some examples, the conveying route R1 is connected (e.g., fluidly coupled) to the supply route R2 through the loading route R3. Additionally, the supply route R2 may be connected to the developing roller 110 through the loading route R3 and the conveying route R1.

The developing agent discharge channel 153*b* accommodates the end portion of the first conveying member 120 and supports the end portion. The developing agent discharge channel 153*b* is provided with a developing agent discharge port (a discharge port) H3. The developing agent discharge port H3 discharges a developing agent degraded by a printing operation to the outside of the developing device 100 by using a variation in volume of the developing agent inside the developing agent storage chamber 160. In some examples, a space inside the developing agent discharge channel 153*b* serves as a developing agent discharge route R4 including the developing agent discharge port H3 discharging the developing agent, in which the developing agent discharge route R4 is connected (e.g., fluidly coupled) to the conveying route R1.

The third housing 153 includes, for example, a connection channel, such as a second connection port H4, connecting the loading route R3 to the developing agent discharge route R4. The developing agent which is sent from the inside of the first housing 151 into the developing agent discharge channel 153*b* is sent into the loading channel 153*a* through the second connection port (or connection channel) H4 and is further sent into the second housing 152.

Figure 4:
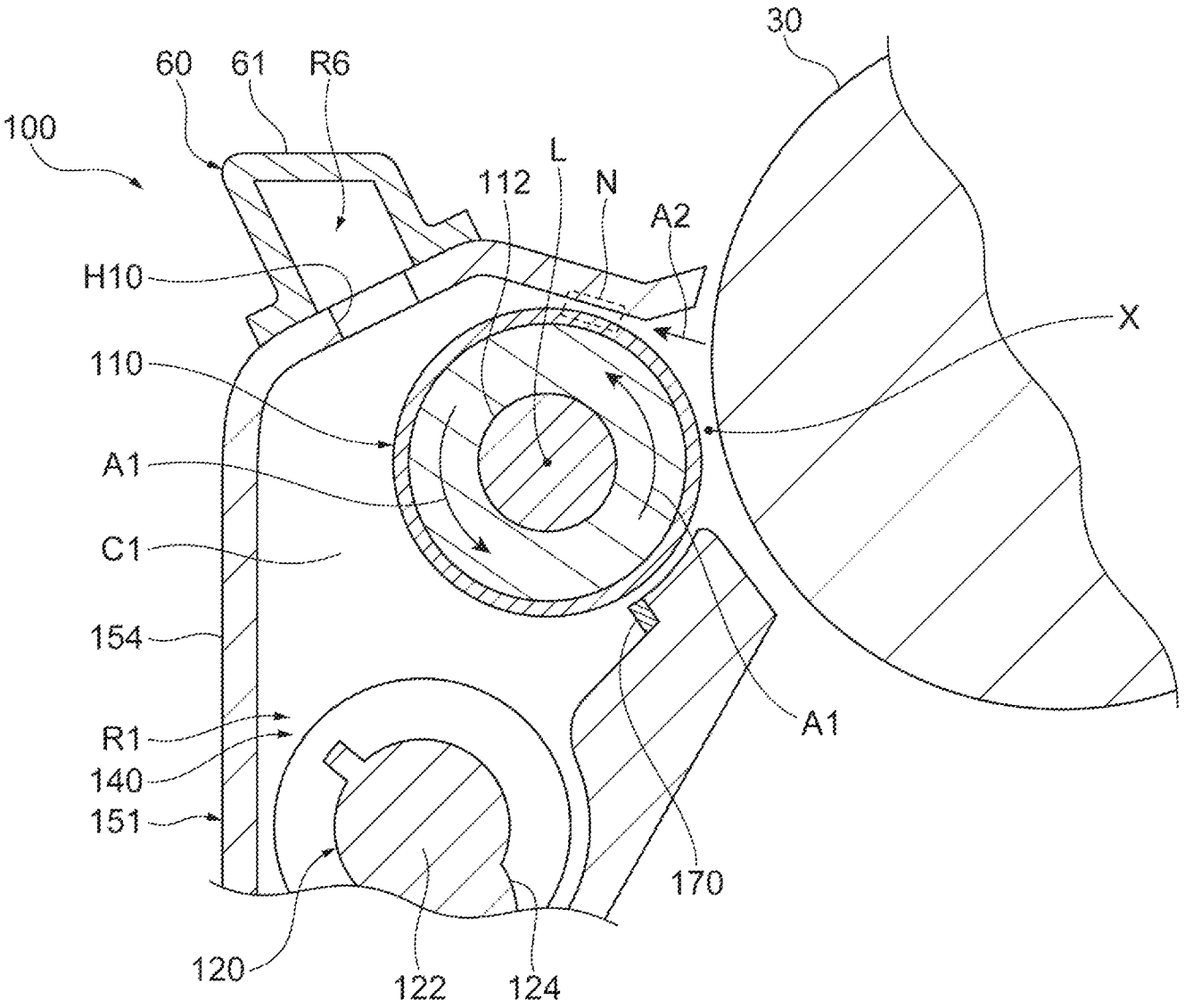
FIG. 4 is a schematic cross-sectional view of the developing device of FIG. 2 taken along a line IV-IV.

As illustrated in FIGS. 2 and 4, the developing roller 110 rotates, for example, about the rotation axis L of the rotation shaft 112 in a direction indicated by the arrow A1 in FIG. 4. The developing roller 110 moves the toner in the carried developing agent at a supply position X (a position in which the developing roller 110 faces the photosensitive drum 30) between the developing roller 110 and the photosensitive drum 30 to the photosensitive drum 30.

A regulation member 170 is provided at an upstream position of the supply position X and a position adjacent to the developing roller 110. Furthermore, the upstream side herein indicates the upstream side in the rotation direction of the developing roller 110. Similarly, the downstream side indicates the downstream side in the rotation direction of the developing roller 110. The regulation member 170 restricts a thickness of the developing agent carried by the developing roller 110. The regulation member 170 may be attached to, for example, the inner surface of the first housing 151.

The first housing 151 includes a casing 154. The casing 154 defines a release chamber C1 between the upstream side of the regulation member 170 and the downstream side of the supply position X in the periphery of the developing roller 110. The release chamber C1 extends in the extension direction of the developing roller 110.

In some examples, the casing 154 is provided with an outlet H10. The casing 154 defines the release chamber C1 with the outlet H10. The outlet H10 may be provided at a plurality of positions in the extension direction of the developing roller 110 or may be provided at one position. Further, the outlet H10 may be provided above the rotation axis L of the developing roller 110.

The developing device 100 is provided with a discharge route R6 which connects the outlet H10 of the release chamber C1 to the inlet H12 of the supply route R2. The inlet H12 of the supply route R2 is located between a portion connected to the loading route R3 and a portion connected to the developing agent supply unit 50 in the supply route R2.

For example, with reference to FIG. 2, the discharge route R6 is formed by, for example, a discharge channel 60. The discharge channel 60 includes, for example, a first discharge channel 61 and a second discharge channel 62. The first discharge channel 61 is provided at a portion provided with the outlet H10 in the outer surface of the casing 154. The first discharge channel 61 forms the discharge route R6 along the outer surface of the casing 154. The release chamber C1 and the discharge route R6 formed by the first discharge channel 61 communicate with each other through the outlet H10.

As illustrated in FIG. 2, the second discharge channel 62 connects the first discharge channel 61 to the supply channel 55. The discharge route R6 which is formed by the second discharge channel 62 communicates with (e.g., is fluidly coupled to) the discharge route R6 formed by the first discharge channel 61. The discharge route R6 which is formed by the second discharge channel 62 is connected to the inlet H12 of the supply route R2 and communicates with (e.g., is fluidly coupled to) the supply route R2.

With reference to FIG. 4, when the developing roller 110 rotates, air is taken into the casing 154 as indicated by the arrow A2 from a gap between the developing roller 110 and the first housing 151, for example, at the downstream position in relation to the supply position X. In some examples, the pressure (air pressure) inside the casing 154 increases. Since the pressure inside the casing 154 increases, an air stream which flows from the release chamber C1 to the supply route R2 through the outlet H10 and the discharge route R6 is generated. For example, as illustrated in FIG. 4, by this air stream, the toner scattered from the inside of the release chamber C1 is sent from the release chamber C1 to the supply route R2 through the outlet H10 and the discharge route R6. Furthermore, the scattered toner is not limited to the toner, but may include the carrier in addition to the toner. The toner (and the carrier) which is sent to the supply route R2 by the air stream is returned to the conveying route R1 again through the loading route R3 and is mixed by the first conveying member 120 and the second conveying member 130.

The discharge route R6 may be located above the developing roller 110 in a posture (e.g., a use posture or configuration) of the developing device 100 at the time of moving the toner to the photosensitive drum 30 by the developing roller 110. In some examples, the toner scattered inside the release chamber C1 can be efficiently guided into the discharge route R6 by the air stream.

For example, as illustrated in FIGS. 2 and 3, the air stream which flows from the discharge route R6 to the supply route R2 flows from the loading route R3 to the developing agent discharge route R4 through the second connection port H4 and is discharged to the outside through the developing agent discharge port H3. In some examples, the developing device 100 can guide the air stream flowing to the supply route R2 through the second connection port H4 to the developing agent discharge route R4. Further, the developing device 100 can suppress an increase in internal pressure by also discharging air from the developing agent discharge port H3.

As illustrated in FIG. 4, the developing agent carried by the developing roller 110 may be nipped at a nip region N between the upper portion of the developing roller 110 and the inner surface of the upper portion of the casing 154. In some examples, the toner scattering amount to the outside of the developing device 100 may change by a relationship between the cross-sectional area of the discharge route R6 and the area of the developing agent nipped at the nip region N as viewed in the rotation axis L of the developing roller 110. For example, the cross-sectional area of the discharge route R6 may be larger than the area of the developing agent nipped at the nip region N. Additionally, the toner scattered inside the release chamber C1 can be efficiently guided to the discharge route R6.

Figure 5:
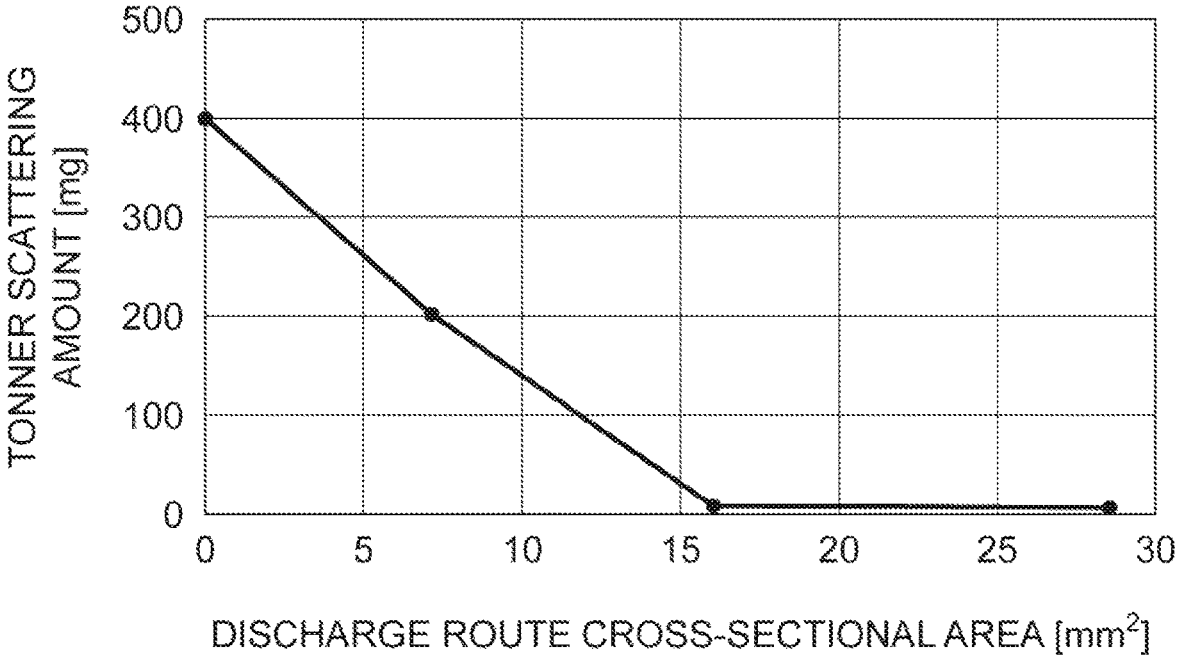
FIG. 5 is a graph illustrating an example toner scattering amount with respect to a cross-sectional area of a discharge route.

Further, as shown in FIG. 5 the toner scattering amount may decrease as the cross-sectional area of the discharge route R6 increases. In some examples, the toner scattering amount abruptly decreases until the cross-sectional area of the discharge route R6 becomes a certain value and the toner scattering amount gently decreases when the cross-sectional area of the discharge route R6 becomes a certain value or more. Accordingly, the cross-sectional area of the discharge route R6 in the discharge channel may be set to be 15 $mm^2$ or more. In some examples, the developing device 100 can decrease the toner scattering amount to the outside of the developing device 100.

Figure 6:
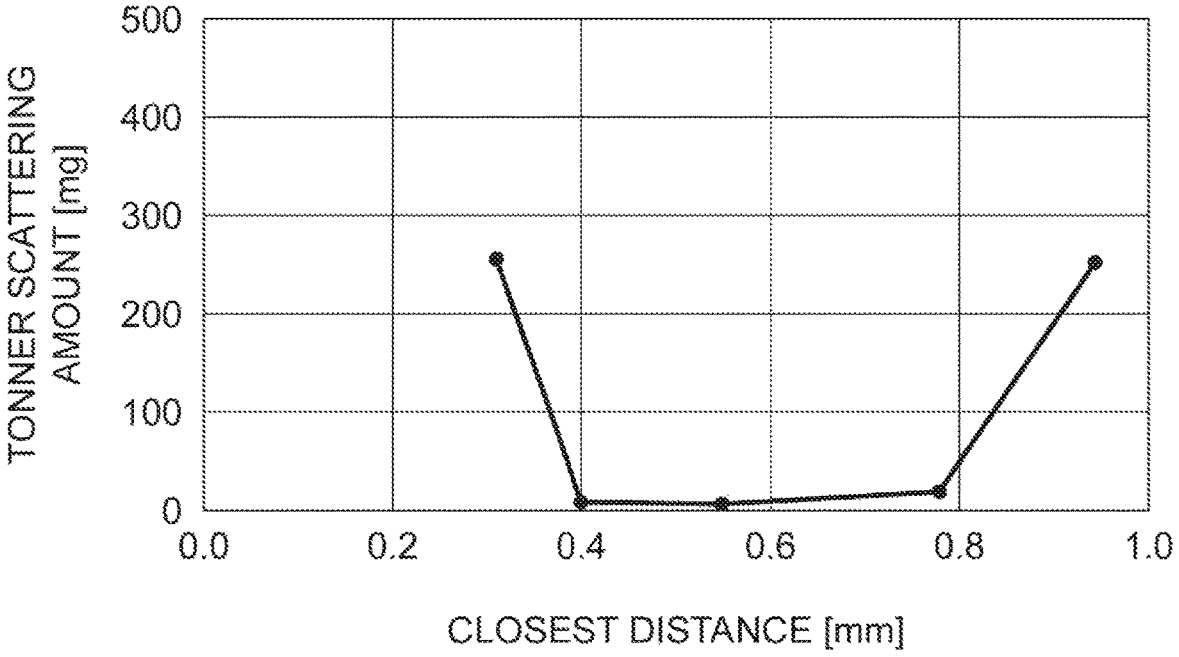
FIG. 6 is a graph illustrating an example toner scattering amount with respect to the closest distance between a developing roller and a casing.

Further, the toner scattering amount may depend on the internal pressure increase state of the developing device 100. An increase in internal pressure of the developing device 100 is involved with, for example, at least one of the closest distance between the upper portion of the developing roller 110 and the inner surface of the upper portion of the casing 154 in the nip region, the developing agent conveying amount of the developing roller 110, and the gap between the developing roller 110 and the photosensitive drum 30. The closest distance may be, for example, equal to or larger than 0.4 mm and equal to or smaller than 0.8 mm. The developing agent conveying amount of the developing roller 110 may be equal to or larger than 450 $g/m^2$ and equal to or smaller than 800 $g/m^2$. The gap between the developing roller 110 and the photosensitive drum 30 may be equal to or larger than 0.25 mm and equal to or smaller than 0.45 mm. In some examples, as shown in FIG. 6, when the closet distance is equal to or larger than 0.4 mm and equal to or smaller than 0.8 mm, the toner scattering amount effectively decreases.

In some examples, with reference to FIGS. 2 and 4, the outlet H10 of the release chamber C1 is connected to the supply route R2 by the discharge route R6. Accordingly, the developing device 100 can send the toner scattered inside the release chamber C1 to the supply route R2 through the outlet H10 and the discharge route R6 along with the air stream generated by an increase in internal pressure. The toner which is sent to the supply route R2 is supplied from the supply route R2 to the developing roller 110 again. Thus, the developing device 100 can decrease the toner scattering amount to the outside of the developing device 100.

Figure 7:
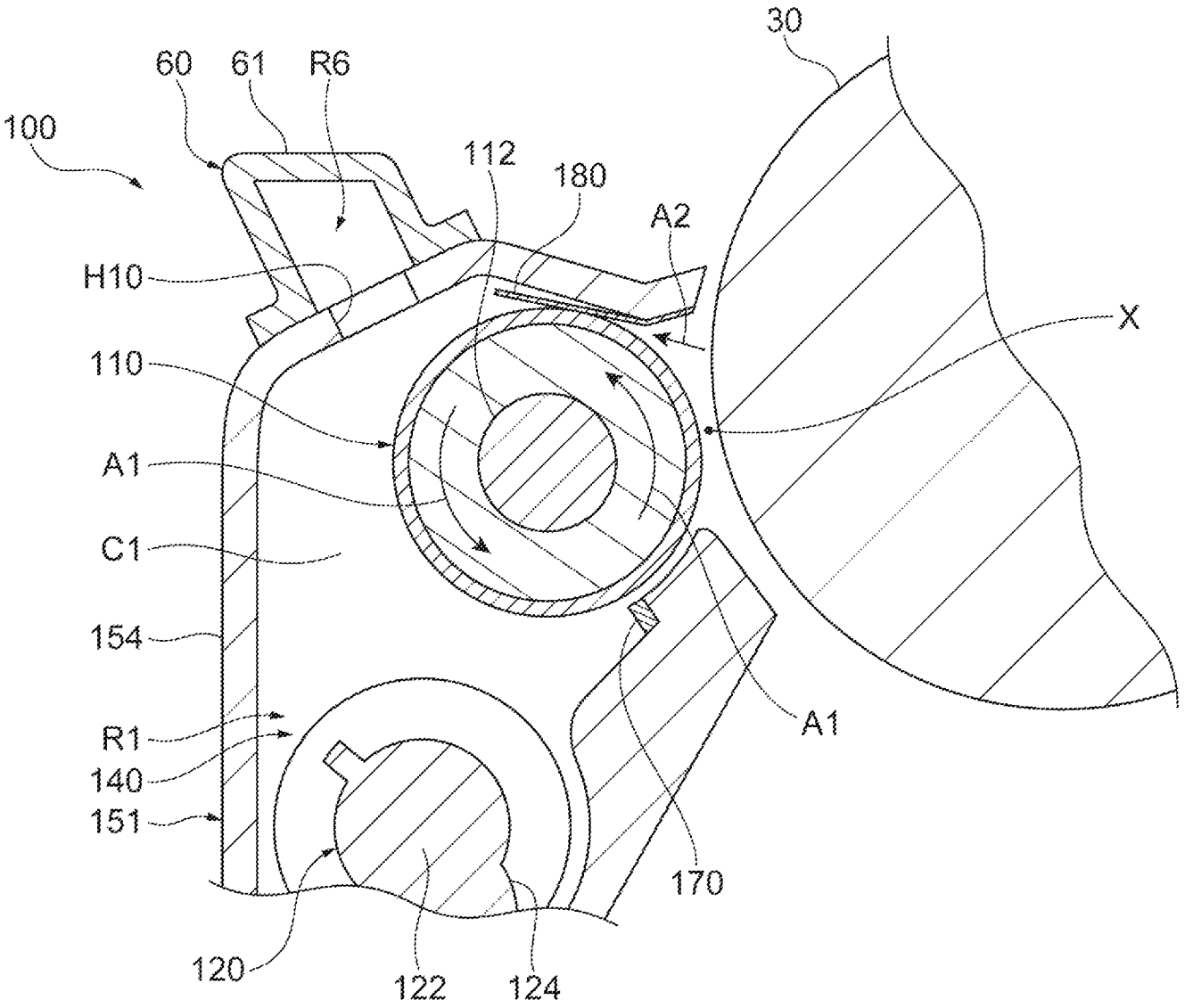
FIG. 7 is a schematic cross-sectional view illustrating a configuration of another example developing device.

As illustrated in FIG. 7, the example developing device 100 may include a seal member 180 between the upper portion of the developing roller 110 and the lower surface of the upper portion of the casing 154. In some examples, the developing device 100 may include the seal member 180 provided between the developing roller 110 and the casing 154 at the downstream position of the supply position X. The seal member 180 may be an elastic body. The seal member 180 may extend in the extension direction of the developing roller 110. The upstream end portion of the seal member 180 may be attached to the inner surface of the upper portion of the casing 154. The seal member 180 may slidably come into contact with the outer peripheral surface of the upper portion of the developing roller 110. In some examples, the developing device 100 can improve the sealing property and airtightness of the developing device 100 by the seal member 180. Accordingly, the developing device 100 can efficiently guide the toner scattered inside the release chamber C1 to the discharge route R6 through the outlet H10.

Figure 8:
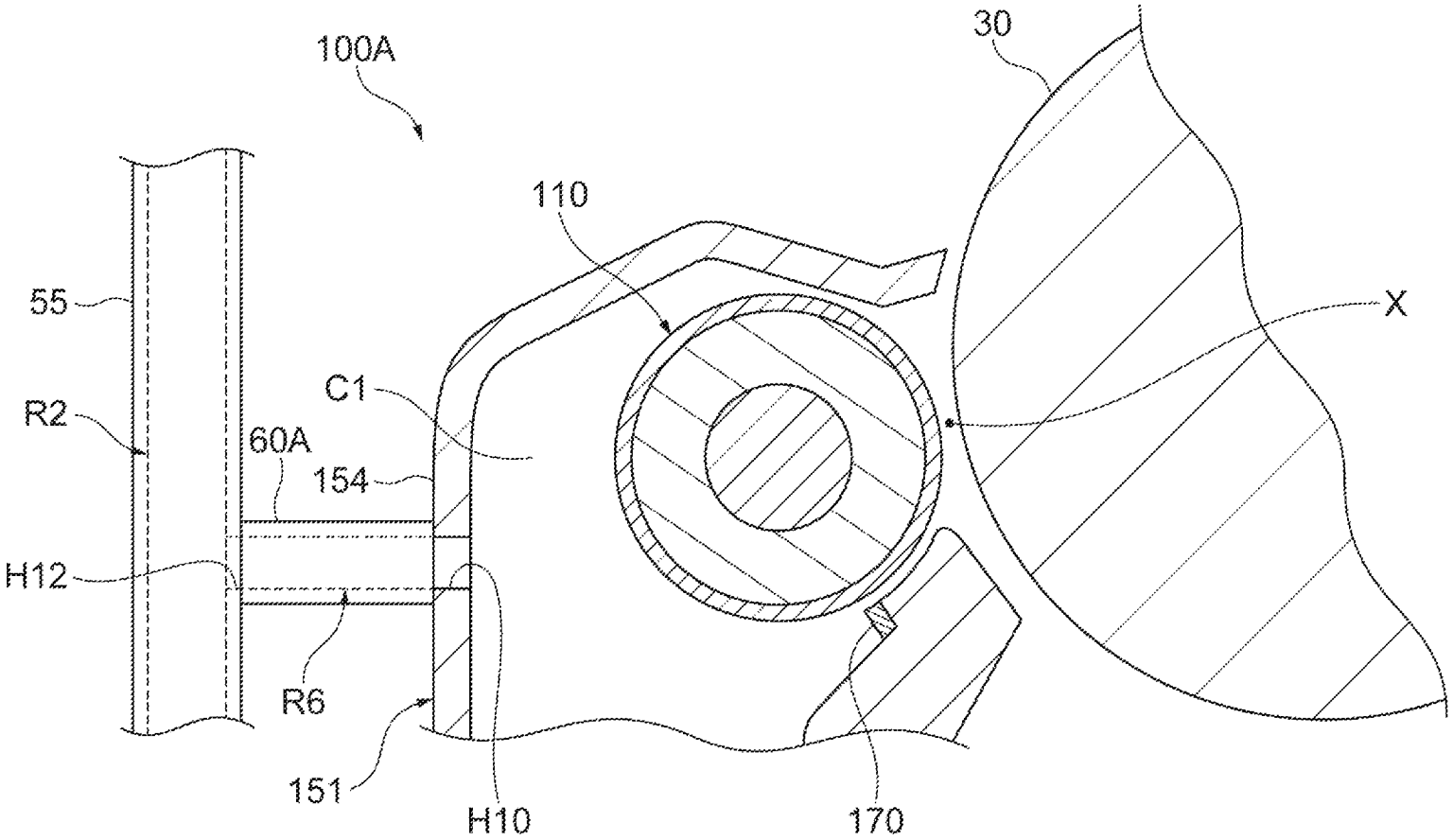
FIG. 8 is a schematic cross-sectional view illustrating a configuration of still another example developing device.

Further, the example developing device 100 may not include the first discharge channel 61 illustrated in FIG. 4 and the like. For example, as illustrated in FIG. 8, the casing 154 of a developing device 100A may be connected to the supply channel 55 by a discharge channel 60A including the discharge route R6. The outlet H10 of the release chamber C1 may be connected to the inlet H12 of the supply route R2 by the discharge route R6 formed by the discharge channel 60A.

Figure 9:
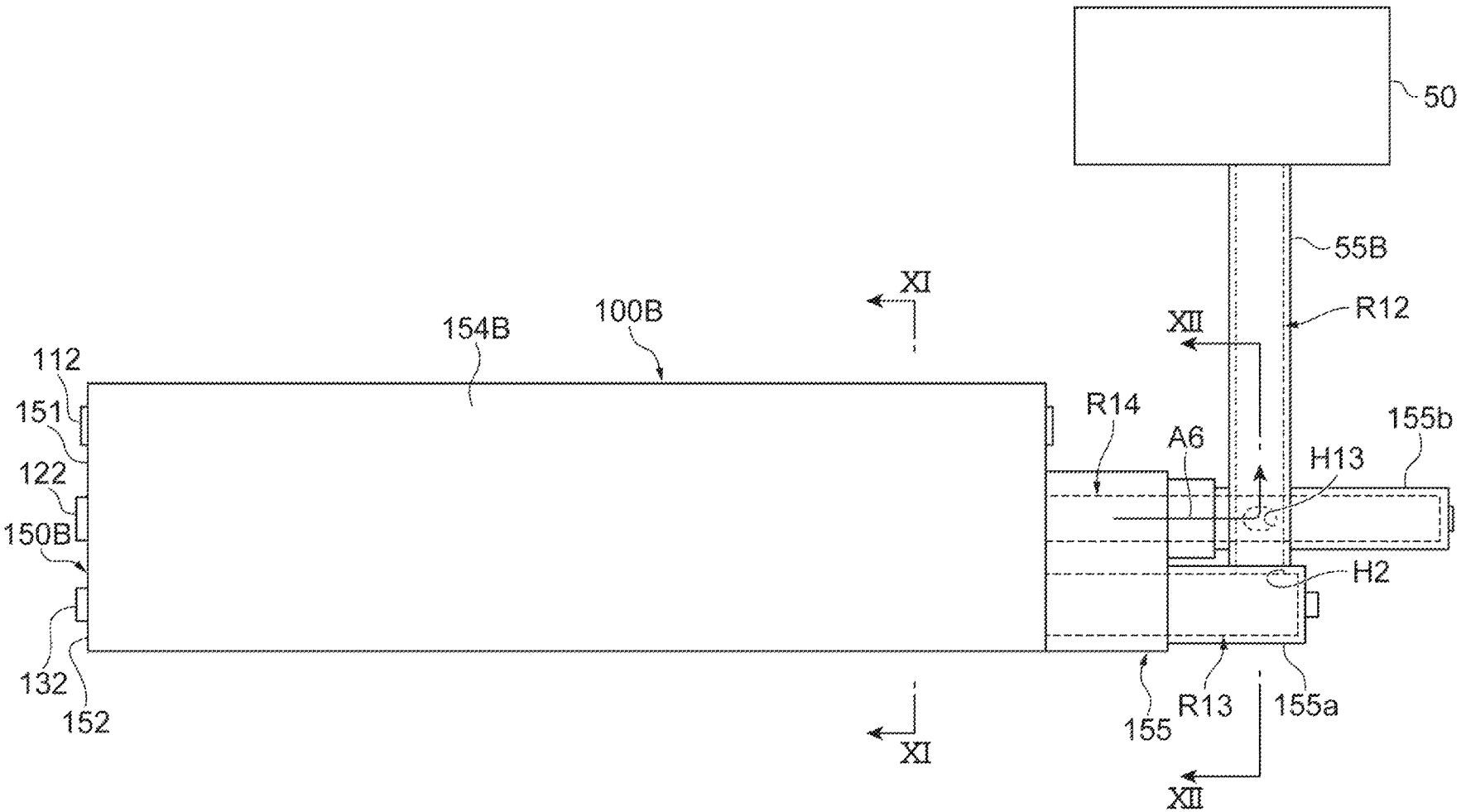
FIG. 9 is a schematic diagram illustrating a configuration of still another example developing device.
Figure 10:
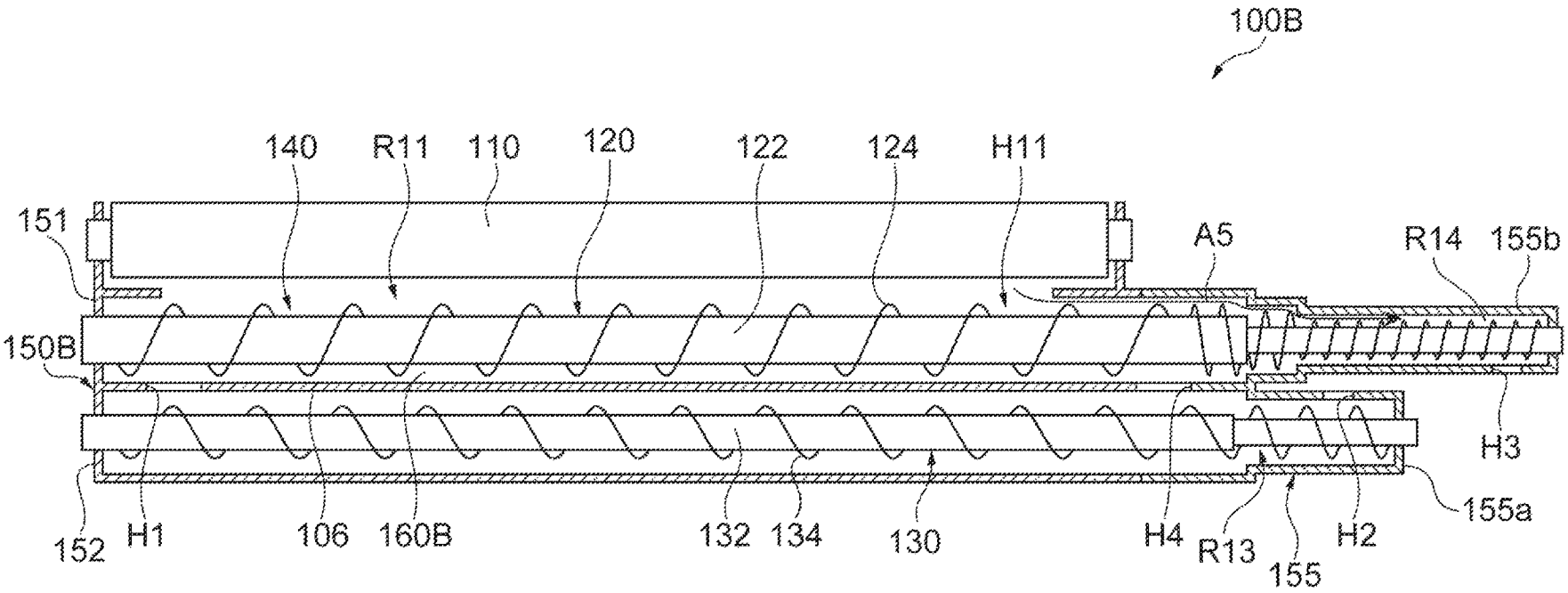
FIG. 10 is a schematic cross-sectional view illustrating an internal configuration of the developing device of FIG. 9.

Next, still another example developing device will be described. As illustrated in FIGS. 9 and 10, a developing device 1006 may include, for example, the developing roller 110, the first conveying member 120, and the second conveying member 130. The developing roller 110, the first conveying member 120, and the second conveying member 130 are provided inside a developing agent storage chamber 160B formed by a housing 150B of the developing device 100.

The housing 150B includes, for example, the first housing 151, the second housing 152, and a third housing 155. The third housing 155 is connected to the end portions of the first housing 151 and the second housing 152. The third housing 155 accommodates the end portions of the first conveying member 120 and the second conveying member 130.

The first support shaft 122 of the first conveying member 120 is rotatably supported by the first housing 151 and the third housing 155. The second support shaft 132 of the second conveying member 130 is rotatably supported by the second housing 152 and the third housing 155.

The second conveying member 130 conveys the developing agent from the third housing 155 toward the first connection port H1 inside the developing agent storage chamber 160B while mixing the developing agent. The first conveying member 120 conveys the developing agent from the first connection port H1 toward the third housing 155 inside the developing agent storage chamber 160B while mixing the developing agent. When the developing agent is conveyed by the first conveying member 120, a part of the developing agent moves to the peripheral surface of the developing roller 110. In some examples, a space inside the first housing 151 and the second housing 152 forms the conveying channel 140 which provides a conveying route R11 supplying the developing agent (the toner) to the developing roller 110. The remaining developing agent which does not move to the peripheral surface of the developing roller 110 is sent from the inside of the first housing 151 into the third housing 155 and is returned from the inside of the third housing 155 into the second housing 152.

The third housing 155 includes, for example, a loading channel 155*a* and a developing agent discharge channel 155*b*. The loading channel 155*a* accommodates the end portion of the second conveying member 130 and supports the end portion. The loading channel 155*a* is provided with the developing agent replenishment port H2. As illustrated in FIG. 9, for example, a supply channel 55B including a supply route R12 is connected to the developing agent supply unit 50. The end portion of the supply channel 55B is connected to the developing agent replenishment port H2 of the loading channel 155*a*. The replenishment developing agent (the toner and the carrier) is supplied from the supply route R12 into the loading channel 155*a* through the developing agent replenishment port H2.

The replenishment developing agent supplied into the loading channel 155*a* passes through the loading channel 155*a* and is sent to the conveying channel 140 (via the conveying route R11) inside the second housing 152. A space inside the loading channel 155*a* serves as a loading route R13 connecting the supply route R12 inside the supply channel 55B to the conveying route R11 of the conveying channel 140 inside the second housing 152. In some examples, the conveying route R11 is connected to the supply route R12 through the loading route R13. Additionally, the supply route R12 may be connected to the developing roller 110 through the loading route R13 and the conveying route R11.

The developing agent discharge channel 155*b* accommodates the end portion of the first conveying member 120 and supports the end portion. The developing agent discharge channel 155*b* is provided with the developing agent discharge port (the discharge port) H3. The developing agent discharge port H3 discharges a developing agent degraded by a printing operation to the outside of the developing device 100B by using a variation in volume of the developing agent inside the developing agent storage chamber 160B. In some examples, a space inside the developing agent discharge channel 155*b* serves as a developing agent discharge route (a discharge route) R14 including the developing agent discharge port H3 discharging the developing agent, in which the developing agent discharge route R14 is connected to the conveying route R11.

The third housing 155 includes, for example, a second connection port H4 connecting the loading route R13 to the developing agent discharge route R14. The developing agent which is sent from the inside of the first housing 151 into the developing agent discharge channel 155*b* is sent into the loading channel 155*a* through the second connection port H4 and is further sent into the second housing 152.

Figure 11:
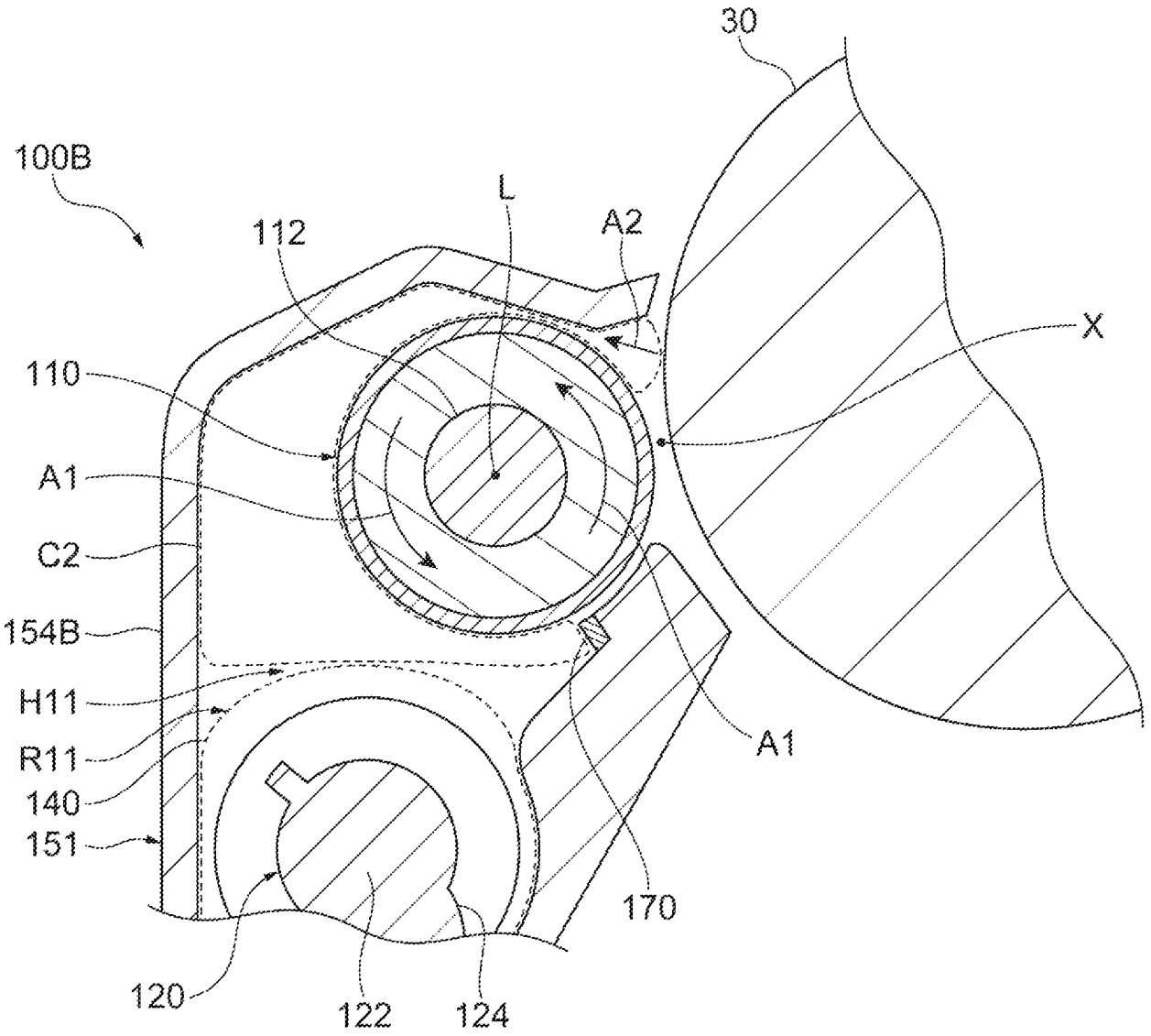
FIG. 11 is a schematic cross-sectional view of the developing device of FIG. 9 taken along a line XI-XI.

As illustrated in FIG. 11, the first housing 151 includes a casing 154B. The casing 154B defines a release chamber C2 between the upstream side of the regulation member 170 and the downstream side of the supply position X in the periphery of the developing roller 110. The release chamber C2 extends in the extension direction of the developing roller 110.

The casing 154B defines the release chamber C2 including an outlet H11. The outlet H11 of the release chamber C2 is located between the release chamber C2 and the conveying channel 140 which defines the conveying route R11. The release chamber C2 and the conveying channel 140 are adjacent to each other, for example, in the vertical direction and communicate with each other at the outlet H11. In some examples, the release chamber C2 is connected to the developing agent discharge route R14 through the outlet H11 of the release chamber C2 and the conveying route R11.

Figure 12:
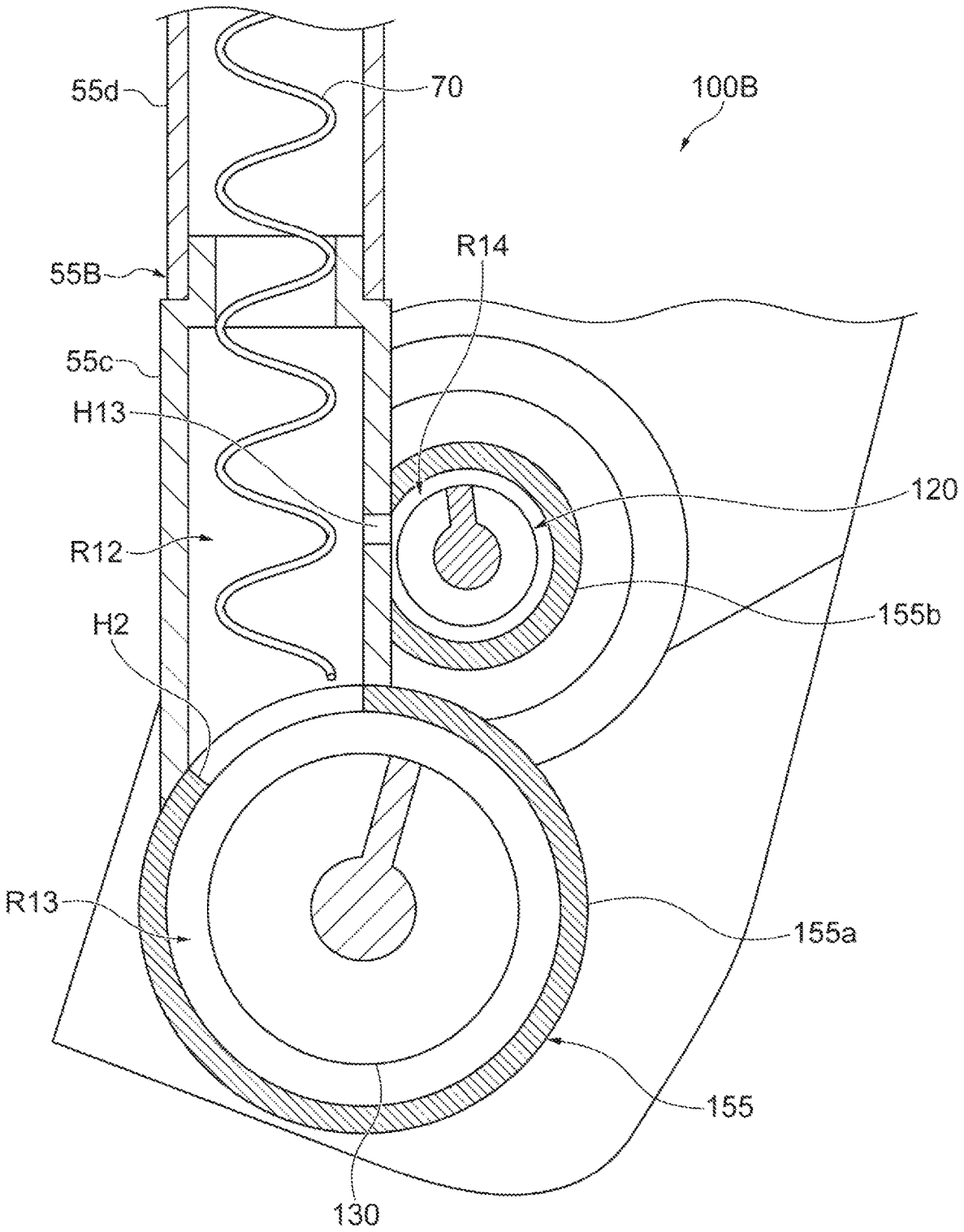
FIG. 12 is a schematic cross-sectional view of the developing device of FIG. 9 taken along a line XII-XII.

The supply route R12 inside the supply channel 55B may be connected to the developing agent discharge route R14 inside the developing agent discharge channel 155*b*. As illustrated in FIGS. 9 and 12, the developing agent discharge route R14 is connected to the inlet H13 of the supply route R12. For example, the developing agent discharge route R14 connects the conveying route R11 to the inlet H13 of the supply route R12. The supply route R12 may be connected to a portion between the developing agent discharge port H3 and a portion connected to the conveying route R11 in the developing agent discharge route R14.

As illustrated in FIG. 12, the inlet H13 of the supply route R12 may be connected to an upper half portion of the developing agent discharge route R14 in the vertical direction in a position or configuration of the developing device 100B at the time of supplying the developing agent to the photosensitive drum 30 by the developing roller 110. Accordingly, the developing agent which is moved inside the developing agent discharge route R14 by the first conveying member 120 may be inhibited from entering into the supply route R12 through the inlet H13.

A conveying device 70 may be provided inside the supply channel 55B which defines the supply route R12. The conveying device 70 conveys the developing agent (i.e., the developing agent supplied from the developing agent supply unit 50 to the supply route R12) to the loading route R13. The conveying device 70 may include, for example, a screw-shaped member or a spring. Additionally, the conveying device 70 may convey the developing agent by, for example, a rotation or an upward/downward operation.

With reference to FIGS. 9 to 11, when the developing roller 110 rotates, air is taken from a gap between the developing roller 110 and the first housing 151 at the downstream position of the supply position X into the casing 154B as indicated by the arrow A2. Accordingly, the pressure (air pressure) inside the casing 154B increases. Since the pressure inside the casing 154B increases, an air stream is generated which flows from the release chamber C2 to the developing agent discharge route R14, via the outlet H11 and the conveying route R11, as indicated by the arrow A5 in FIG. 10. The air stream flows from the developing agent discharge route R14 to the supply route R12 through the inlet H13, as indicated by the arrow A6 in FIG. 9. By this air stream introduced into the supply route R12, the developing agent inside the supply route R12 is sent to the loading route R13.

As described above, the outlet H11 of the release chamber C2 is connected to the inlet H13 of the supply channel 55B (defining the supply route R12) through the conveying channel R11 (defining the conveying route R11) and the developing agent discharge channel 155*b* (defining the developing agent discharge route R14). Accordingly, the example developing device 100B can guide an air stream generated by an increase in internal pressure to the supply route R12 and can send the developing agent inside the supply route R12 to the loading route R13 by the air stream. Accordingly, the developing device 100B can suppress the jamming of the developing agent inside the supply route R12. For example, the developing device 100B can suppress the jamming of the developing agent at the connection portion between the supply route R12 and the loading route R13.

Further, the developing device 100B can guide a part of the air stream directed from the conveying route R11 to the developing agent discharge port H3 of the developing agent discharge route R14 inside the developing agent discharge route R14 to the supply route R12. Since the developing device 100B can reduce the air stream directed toward the developing agent discharge port H3 inside the developing agent discharge route R14, the amount of the developing agent discharged from the developing agent discharge port H3 along with the air stream may be decreased. Thus, the developing device 100 can suppress an excessive discharge of the developing agent from the developing agent discharge port H3 along with the air stream generated by an increase in internal pressure.

Figure 13:
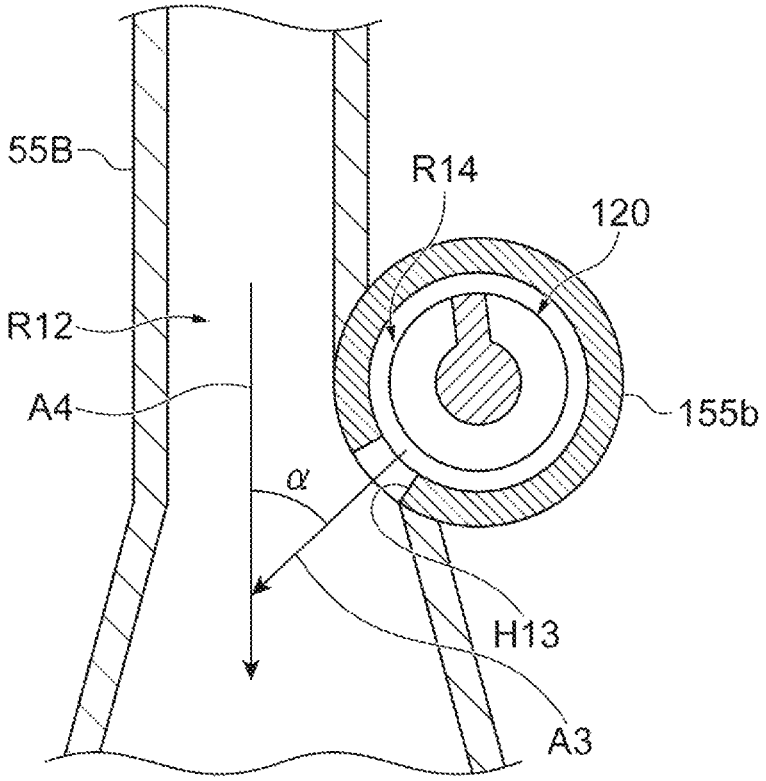
FIG. 13 is a schematic cross-sectional view illustrating still another example developing device.

As illustrated in FIG. 13, the supply route R12 and the developing agent discharge route R14 may be connected to each other so that an angle α formed between a facing direction of the inlet H13 of the supply route R12 (a direction indicated by the arrow A3) and a flow direction of the developing agent in the supply route R12 (a direction indicated by the arrow A4) is smaller than 90°. For example, the facing direction may be a flow direction of the toner through the inlet H13 of the supply channel 55B. Accordingly, an air stream inside the supply route R12 is guided from the developing agent discharge route R14 toward the downstream side in the flow direction of the developing agent in the supply route R12 through the inlet H13. Since the developing agent is pushed toward the loading route R13 by the air stream flowing into the supply route R12, jamming of the developing agent inside the supply route R12 may be suppressed or prevented.

In the supply route R12 illustrated in FIG. 13, a downstream portion of the inlet H13 connected to the developing agent discharge route R14 may spread widely. Since the developing agent is easily conveyed from the supply route R12 to the loading route R13, jamming of the developing agent inside the supply route R12 may be suppressed or prevented.

Figure 14:
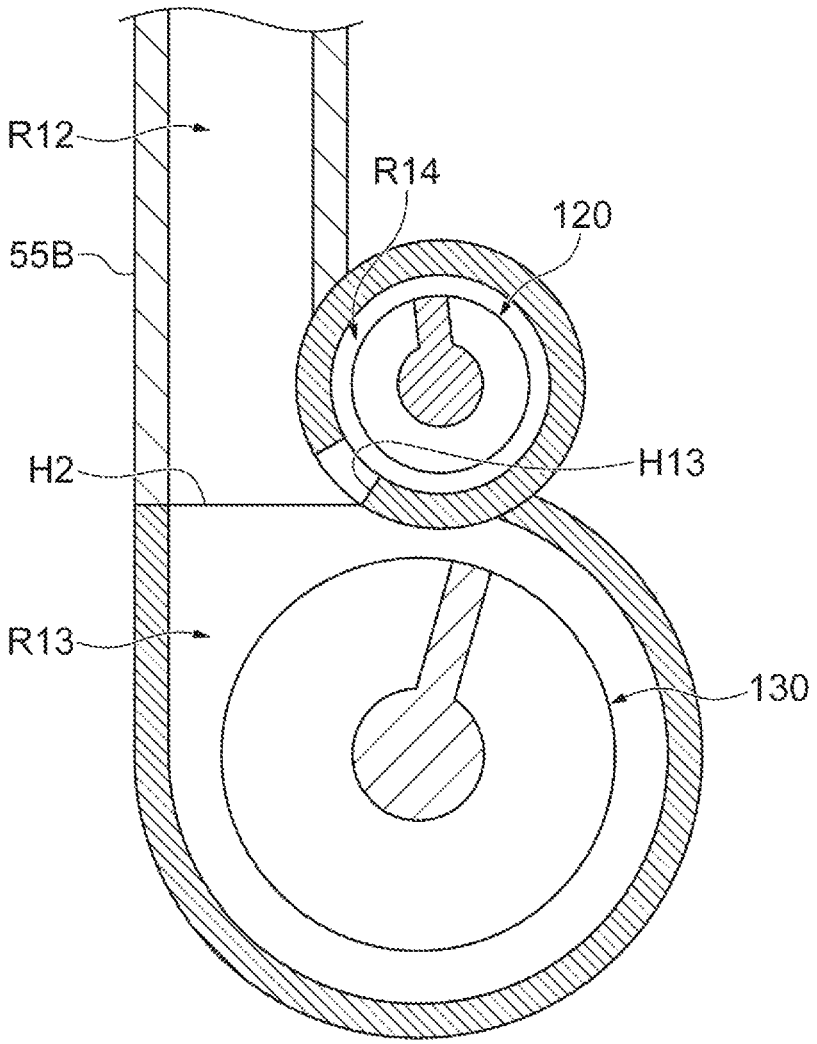
FIG. 14 is a schematic diagram illustrating still another example developing device.

Further, as illustrated in FIG. 14, the inlet H13 of the supply route R12 may be located adjacent to a position in which the supply route R12 is connected to the loading route R13. In some examples, jamming of the developing agent at the connection portion between the supply route R12 and the loading route R13 may be suppressed or prevented.

The supply channel 55B illustrated in FIG. 12 may include a first supply channel 55*c* which is connected to the loading channel 155*a* and a second supply channel 55*d* which is connected to the end portion on the side of the developing agent supply unit 50 in the first supply channel 55*c*. In some examples, the first supply channel 55*c* and the second supply channel 55*d* may be connected to each other in an attachable/detachable manner. Additionally, a mechanism may be provided to allow the conveying device 70 to be retracted into the second supply channel 55*d* so that the conveying device does not pop out from the second supply channel 55*d* when the second supply channel 55*d* is separated from the first supply channel 55*c*.

The material of the second supply channel 55*d* may be, for example, rubber. The material of the first supply channel 55*c* may be, for example, plastic resin or the like. When the loading channel 155*a*, the developing agent discharge channel 155*b*, and the first supply channel 55*c* are formed of plastic resin, any two or all of these may be integrally molded.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. An imaging system comprising:

a developing device comprising:

a developing roller connected to a supply channel to supply a developing agent including toner, the developing roller to transfer the toner in the developing agent to a photosensitive drum at a supply position between the developing roller and the photosensitive drum;

a regulation member located adjacent to the developing roller at an upstream side of the supply position to restrict a thickness of the developing agent carried on the developing roller;

a casing that forms a release chamber in a periphery of the developing roller between an upstream side of the regulation member and a downstream side of the supply position to collect scattered toner, the release chamber having an outlet;

a first discharge channel that connects the outlet of the release chamber to an inlet of the supply channel, the first discharge channel to discharge the scattered toner from the outlet of the release chamber to the inlet of the supply channel; and a second discharge channel different from the first discharge channel and comprising a discharge port to discharge a portion of the developing agent from an inside of the developing device to an outside of the developing device along a route different from a route leading to the inlet of the supply channel.

2. The imaging system according to claim 1, wherein the outlet of the release chamber is formed in the casing.

3. The imaging system according to claim 1, wherein the first discharge channel is located above the developing roller when the toner is transferred to the photosensitive drum by the developing roller.

4. The imaging system according to claim 1, wherein a cross-sectional area of the first discharge channel is 15 $mm^2$ or more.

5. The imaging system according to claim 1, further comprising:

a conveying channel connected to the supply channel to supply the developing agent to the developing roller, wherein the outlet of the release chamber is located between the release chamber and the conveying channel, and wherein the first discharge channel connects the conveying channel to the inlet of the supply channel.

6. The imaging system according to claim 1, wherein the inlet of the supply channel is connected between the first discharge channel and the second discharge channel.

7. The imaging system according to claim 1, wherein the inlet of the supply channel is connected to an upper half portion of the first discharge channel when the toner is supplied to the photosensitive drum by the developing roller.

8. The imaging system according to claim 1, wherein the supply channel and the first discharge channel are connected to each other to form an angle between a flow direction of the toner through the inlet of the supply channel and a flow direction of the developing agent in the supply channel, and wherein the angle is smaller than 90°.

9. The imaging system according to claim 1, wherein a portion of the supply channel on a downstream side of the inlet that is connected to the first discharge channel widens in a flow direction of the developing agent in the supply channel.

10. The imaging system according to claim 1, further comprising:

a conveying device provided inside the supply channel to convey the developing agent inside the supply channel.

11. The imaging system according to claim 1, further comprising:

a conveying channel connected to the supply channel to supply the developing agent to the developing roller, wherein the second discharge channel is connected to the conveying channel.

12. The imaging system according to claim 11, further comprising:

a loading channel that connects the supply channel to the conveying channel; and a connection channel that connects the second discharge channel to the loading channel.

13. The imaging system according to claim 1, further comprising:

a seal member located between the developing roller and the casing, the seal member being at a downstream side of the supply position.

14. The imaging system according to claim 13, wherein an upstream end portion of the seal member is attached to the casing, the seal member to slidably contact an outer peripheral surface of the developing roller.

15. The imaging system according to claim 1, wherein the portion of the developing agent discharged by the discharge port is degraded by an operation of the imaging system.

16. An imaging system comprising:

a developing device;

a supply channel separate from the developing device and comprising a supply route to supply a developing agent to a replenishment port of the developing device, wherein the developing device is connected to the supply channel and comprises:

a developing roller to transfer toner in the developing agent to a photosensitive drum at a supply position between the developing roller and the photosensitive drum;

a regulation member located adjacent to the developing roller at an upstream side of the supply position to restrict a thickness of the developing agent carried on the developing roller;

a casing that forms a release chamber in a periphery of the developing roller between an upstream side of the regulation member and a downstream side of the supply position to collect scattered toner, the release chamber having an outlet; and a discharge channel that connects the outlet of the release chamber to an inlet of the supply channel, the discharge channel to discharge the scattered toner from the outlet of the release chamber to the inlet of the supply channel, wherein the discharge channel is located above the developing roller in a posture of the developing device at a time of transferring the toner to the photosensitive drum by the developing roller.

17. The imaging system according to claim 16, wherein the discharge channel is a first discharge channel, and wherein the developing device further comprises:

a second discharge channel below the first discharge channel in the posture of the developing device at the time of transferring the toner to the photosensitive drum by the developing roller, wherein the second discharge channel comprises a discharge port to discharge a portion of the developing agent from an inside of the developing device to an outside of the developing device.

18. The imaging system according to claim 17, wherein the developing device further comprises:

a conveying channel to receive the developing agent from the supply channel and to supply the developing agent to the developing roller, wherein the second discharge channel is connected to an end of the conveying channel.

19. A developing device comprising:

a developing roller to receive a developing agent including toner from a supply channel, the developing roller to transfer the toner in the developing agent to a photosensitive drum at a supply position between the developing roller and the photosensitive drum;

a regulation member located adjacent to the developing roller at an upstream side of the supply position to restrict a thickness of the developing agent carried on the developing roller;

a casing that forms a release chamber in a periphery of the developing roller between an upstream side of the regulation member and a downstream side of the supply position to collect scattered toner, the release chamber having an outlet;

a first discharge channel to connect the outlet of the release chamber to an inlet of the supply channel, the first discharge channel to discharge the scattered toner from the outlet of the release chamber to the inlet of the supply channel; and a second discharge channel different from the first discharge channel and comprising a discharge port to discharge a portion of the developing agent from an inside of the developing device to an outside of the developing device along a route different from a route leading to the inlet of the supply channel.

* * * * *